US010463905B1

(12) United States Patent
Smith, Jr.

(10) Patent No.: US 10,463,905 B1
(45) Date of Patent: Nov. 5, 2019

(54) VARIABLE RESISTANCE EXERCISE BAND

(71) Applicant: Alfred Sidney Smith, Jr., Sammamish, WA (US)

(72) Inventor: Alfred Sidney Smith, Jr., Sammamish, WA (US)

( * ) Notice: Subject to any disclaimer, the term of this patent is extended or adjusted under 35 U.S.C. 154(b) by 373 days.

(21) Appl. No.: 15/409,736

(22) Filed: Jan. 19, 2017

(51) Int. Cl.

| | |
|---|---|
| ***A63B 21/055*** | (2006.01) |
| ***A63B 21/04*** | (2006.01) |
| ***A63B 21/16*** | (2006.01) |
| ***A63B 21/00*** | (2006.01) |
| ***A63B 23/035*** | (2006.01) |
| ***A63B 23/04*** | (2006.01) |
| ***A41D 1/04*** | (2006.01) |

(52) U.S. Cl.
CPC ..... *A63B 21/0557* (2013.01); *A41D 1/04* (2013.01); *A63B 21/00061* (2013.01); *A63B 21/00065* (2013.01); *A63B 21/0442* (2013.01); *A63B 21/0555* (2013.01); *A63B 21/16* (2013.01); *A63B 21/1654* (2013.01); *A63B 21/4007* (2015.10); *A63B 21/4015* (2015.10); *A63B 21/4034* (2015.10); *A63B 21/4035* (2015.10); *A63B 21/4043* (2015.10); *A63B 23/0355* (2013.01); *A63B 23/0405* (2013.01)

(58) Field of Classification Search
None
See application file for complete search history.

(56) References Cited

U.S. PATENT DOCUMENTS

| | | | | |
|---|---|---|---|---|
| 5,186,698 | A * | 2/1993 | Mason | A63B 21/0552 482/121 |
| 5,306,222 | A * | 4/1994 | Wilkinson | A41D 13/0015 482/121 |
| 5,352,174 | A * | 10/1994 | Mason | A63B 21/0004 482/129 |
| 5,704,856 | A * | 1/1998 | Morse | A63B 21/0004 473/212 |
| 6,238,324 | B1 * | 5/2001 | MacMillan | A63B 21/00043 482/12 |
| 7,611,450 | B2 * | 11/2009 | Mancini | A63B 21/04 482/123 |
| 7,798,945 | B2 * | 9/2010 | Ko | A63B 21/0004 482/121 |
| 7,935,036 | B2 * | 5/2011 | Haynes | A63B 21/4025 482/121 |

(Continued)

*Primary Examiner* — Stephen R Crow
(74) *Attorney, Agent, or Firm* — Quickpatents, LLC; Kevin Prince

(57) ABSTRACT

A resistance band apparatus for a person to perform resistance exercises includes a pair of rigid resistance band buckles each having a first end and a second end. The first end has a first attachment mechanism and the second end has at least one second attachment mechanism. At least one elastomeric resistance band has two opposing ends, each end adapted for attachment to the second attachment mechanism of one of the resistance band buckles. Multiple resistance bands may be included, some having a unique length and/or elasticity. The resistance bands are interchangeable and selectively fixed with the buckles. The apparatus may further include a proximal strap fixed between a first resistance band buckle and a user interface mechanism such as a handle, and a distal strap fixed between a second opposing resistance band buckle and an object engagement mechanism, such as a door bracket.

18 Claims, 7 Drawing Sheets

(56) References Cited

U.S. PATENT DOCUMENTS

| | | | | |
|---|---|---|---|---|
| 7,946,970 | B2 * | 5/2011 | Garza, Jr. | A63B 21/4017 482/126 |
| 8,303,473 | B2 * | 11/2012 | Gutierrez | A63B 21/00 482/121 |
| 8,562,494 | B2 * | 10/2013 | Thomas | A63B 21/0555 482/121 |
| 9,061,173 | B1 * | 6/2015 | Felkel | A63B 21/0557 |
| 9,242,137 | B1 * | 1/2016 | Hoffman | A63B 21/1645 |
| 9,345,922 | B2 * | 5/2016 | Allison | A63B 21/0442 |
| 2005/0261113 | A1 * | 11/2005 | Wilkinson | A63B 21/0004 482/124 |
| 2009/0093344 | A1 * | 4/2009 | Rastegar | A63B 69/0064 482/43 |
| 2010/0292055 | A1 * | 11/2010 | Andrich | A63B 21/00043 482/122 |
| 2014/0024508 | A1 * | 1/2014 | Hinds | A63B 21/02 482/129 |
| 2015/0024911 | A1 * | 1/2015 | Ross | A63B 21/0442 482/129 |
| 2018/0178049 | A1 * | 6/2018 | Marquez | A63B 21/0442 |
| 2018/0184731 | A1 * | 7/2018 | Li | A63B 71/12 |
| 2018/0200556 | A1 * | 7/2018 | Dinkins | A63B 21/028 |

* cited by examiner

VARIABLE RESISTANCE EXERCISE BAND

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to exercise equipment, and more particularly to variable-resistance exercise bands.

DISCUSSION OF RELATED ART

Exercises that include elastomeric resistance bands are becoming more popular due to the compact size and portability of resistance bands. However, currently available resistance band devices have a fixed elasticity that provides no option for increasing or decreasing the elasticity while also providing the option of a non-linear elasticity as the bands are stretched, which is sometimes desired based on the type of exercises being performed. Still further, prior art devices are limited in terms of the types of user interface mechanisms employed, and are usually just provided with a fixed "ski handle" type device. Limited provisions are made for providing other types of user interface devices, such as elongated poles, foot straps, or the like.

Therefore, there is a need for an elastic resistance band exercising device that provides for interchanging resistance bands of varying elasticity. Further, such a needed invention would allow for non-linear elasticity as the resistance band is stretched, and would further allow for quick interchanging of both user interface mechanisms and fixed object engagement mechanisms. The needed invention is relatively inexpensive to manufacture and simple to use, transport and store. The present invention accomplishes these objectives.

SUMMARY OF THE INVENTION

The present device is a resistance band apparatus for a person to perform resistance exercises. Typically, such resistance exercises are performed by the person pulling one end of the apparatus while the other end is fixed with a fixed object, such as a door or other piece of fixed exercise equipment.

A pair of rigid resistance band buckles each include a first end and a second end. The first end has a first attachment mechanism and the second end has at least one second attachment mechanism. The first attachment mechanism may include a rigid eyelet, for example.

At least one elastomeric resistance band has two opposing ends, each end adapted for attachment to the second end of one of the resistance band buckles. As such, the person pulls each resistance band buckle apart to stretch the elastomeric resistance band and perform the resistance exercises. Preferably the at least one elastomeric resistance band is a plurality of the elastomeric resistance bands, each having a unique length or elasticity. The resistance bands may be interchangeable and selectively fixed with the buckles.

Preferably the resistance band apparatus further includes a proximal strap fixed at a distal end thereof with the first attachment mechanism of a first resistance band buckle. The proximal strap is fixed at a proximal end thereof with a user interface mechanism, such as a ring handle, an elongated bar, a training vest, a foot strap, a skit handle, or the like. The proximal strap may further include a length adjustment buckle.

A distal strap may be fixed at a proximate end thereof with the first attachment mechanism of a second opposing resistance band buckle. The distal strap is fixed at a distal end thereof with an object engagement mechanism, such as an L-shaped door bracket, a carabiner, another strap, or the like. With the object engagement mechanism fixed with the fixed object, the person may use the user interface mechanism to pull the resistance bands apart to perform the resistance exercises. The distal strap may further include another of the length adjustment buckles.

The present device is an elastic resistance band that provides for quick interchanging resistance bands of varying elasticity. Further, the present invention allows for non-linear elasticity as the resistance band is stretched, and for quick interchanging of both user interface mechanisms and fixed object engagement mechanisms. The present invention is relatively inexpensive to manufacture and simple to use, transport and store. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

FIGS. 1-4 illustrate a resistance band apparatus 10 for a person 20 to perform resistance exercises. Typically, such resistance exercises are performed by the person 20 pulling one end of the apparatus 10 while the other end is fixed with a fixed object 15, such as a door or other piece of fixed exercise equipment.

Figure 1:
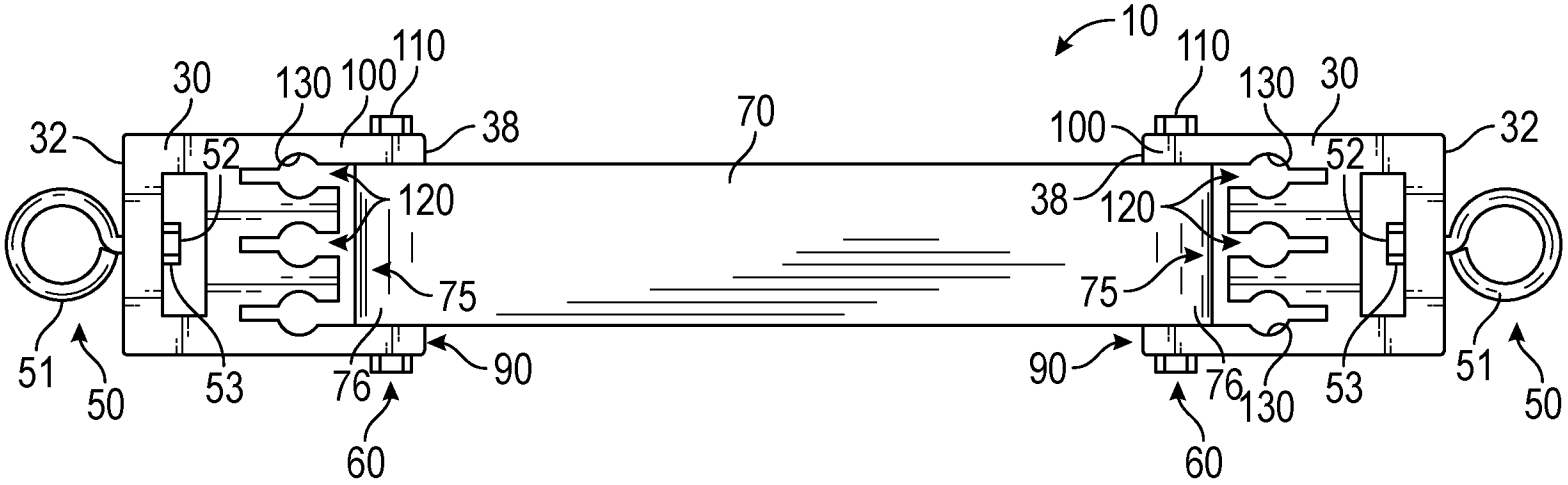
FIG. 1 is a top plan view of the invention.
Figure 2:
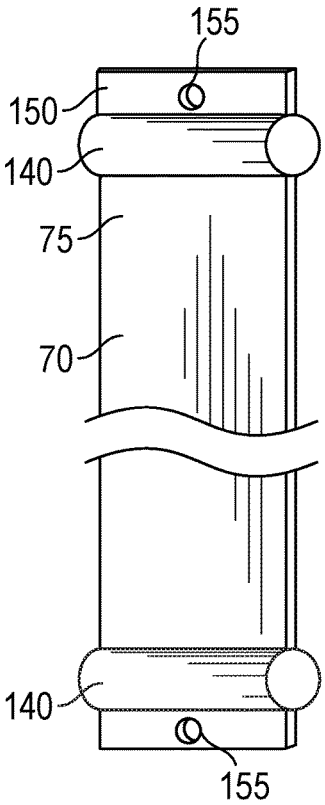
FIG. 2 is a perspective view of one embodiment of an elastomeric resistance band of the invention.
Figure 3:
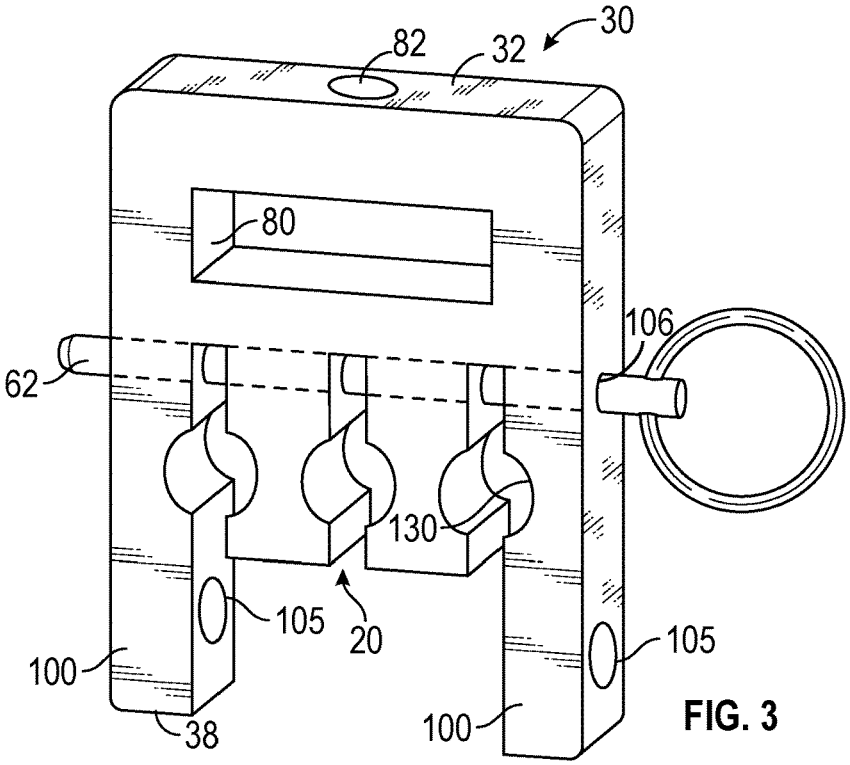
FIG. 3 is a perspective view of a resistance band buckle of the invention.
Figure 4:
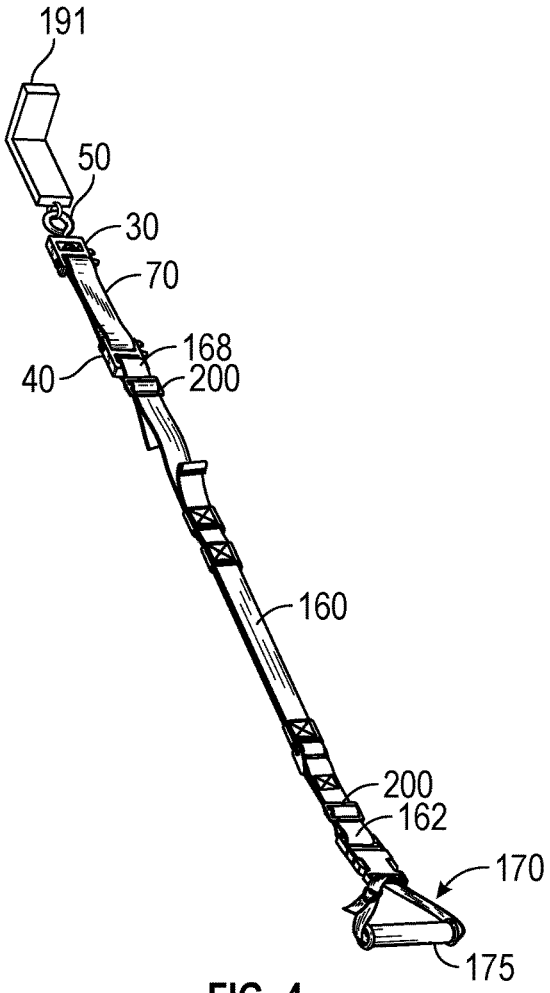
FIG. 4 is a perspective view of an alternate embodiment of the invention.

A pair of rigid resistance band buckles 30 each include a first end 32 and a second end 38. The first end 32 has a first attachment mechanism 50 and the second end 38 has at least one second attachment mechanism 60. The first attachment mechanism 50 may include a rigid eyelet 51 that preferably includes a threaded shaft 52 projecting through a longitudinal aperture 81 of the first end 32 of each buckle 30 and into an elongated fastener aperture 80 to receive a threaded nut 53 (FIGS. 1 and 3). Alternate first attachment mechanisms 50 may be utilized as are known, or become known, in the art of attaching straps or other objects to buckles. Each buckle 30 is preferably made from a rigid metal or plastic material.

Figure 9:
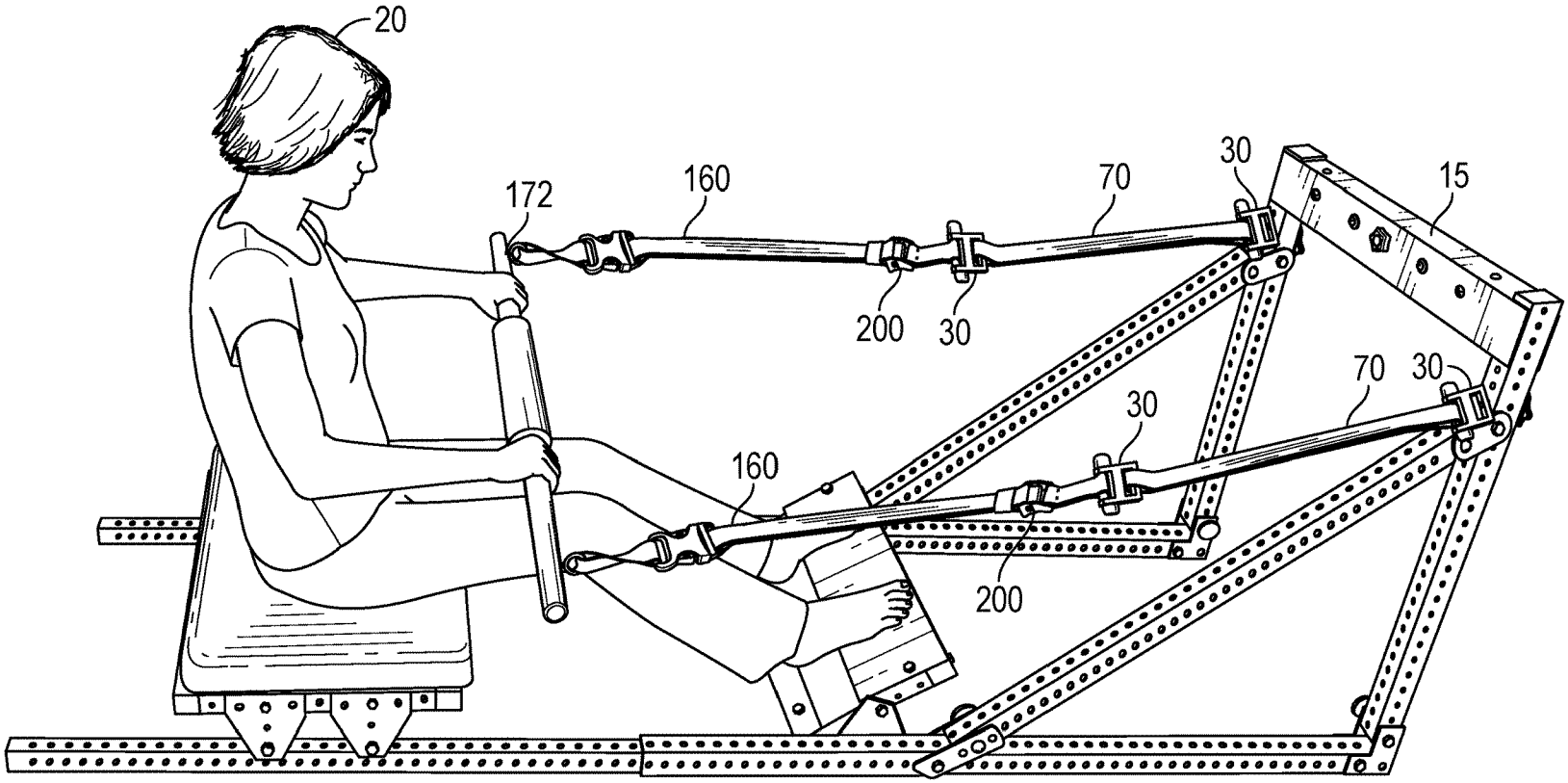
FIG. 9 is a perspective view of the invention, showing an embodiment of the user engagement mechanism in the form of an elongated bar.

At least one elastomeric resistance band 70 has two opposing ends 75, each end 75 adapted for attachment to the second end 38 of one of the resistance band buckles 30, resulting in the second ends 38 of each of the resistance band buckles 30 being fixed with opposing ends 75 of the at least one resistance band 70. Such elastomeric resistance bands 70 can take several forms, but are preferably flat elastomeric bands (FIG. 2), flat elastomeric rubber-band shaped bands 70 (FIG. 9), bungee-cord type bands, or the like.

As such, the person 20 pulls each resistance band buckle 30 apart to stretch the elastomeric resistance band 70 and perform the resistance exercises. Preferably the at least one elastomeric resistance band 70 is a plurality of the elastomeric resistance bands 70, each having a unique length such that as the buckles 30 are pulled apart and the resistance bands 70 are stretched, the total resistance experienced by the person 20 increases as more of the resistance bands 70 become taut. In some embodiments, at least two of the resistance bands 70 having unique elasticity such that the person 20 may select one or more of the resistance bands 70 to obtain a desired resistance. For example, when exercising the leg muscles, resistance bands 70 having lower elasticity, and therefore providing more resistance to stretching, may be used, while when exercising the arm muscles less resistance is needed so resistance bands 70 having a higher elasticity may be used.

Preferably the second end 38 of each buckle 30 a clevis 90 having a pair of opposing lateral bolt fingers 100, a fastening bolt 110 adapted to traverse a pair of opposing and aligned bolt apertures 105 formed through the bolt fingers 100 and to receive therearound a loop 76 formed at each of the ends 75 of at least one of the elastomeric resistance bands 70 (FIG. 1). As such, the fastening bolt 110 of each buckle 30 can be inserted through one of the fingers 100, through the loop 76 of one end 75 of the at least one elastomeric band 70, and through the opposing finger 100 to secure the elastomeric band 70 to the buckle 30.

Preferably each buckle 30 further includes a plurality of resistance band slots 120 accessible from the second end 38 of the buckle 30. Each slot 120 includes at least a portion of the second attachment mechanism 60 such as a widened keyway 130 (FIG. 3) for receiving therein a corresponding widened head 140 (FIG. 2) of at least one of the resistance bands 70, such that the slot 120 retains the resistance band 70 therein with the resistance band 70 is stretched. The at least one resistance band 70 preferably further includes a tab 150 projecting away from the head 140, the tab 150 including a pin aperture 155 therethrough. Each buckle 30 in such an embodiment includes a transverse pin aperture 106 at each slot 120 proximate the tab 150 when the resistance band 70 is engaged with the slot 120. A pin 62 is adapted for fixing the resistance band 70 further to the slot 120, inhibiting the resistance band 70 from inadvertently sliding out of the widened keyway 130 and slot 120.

Figure 5:
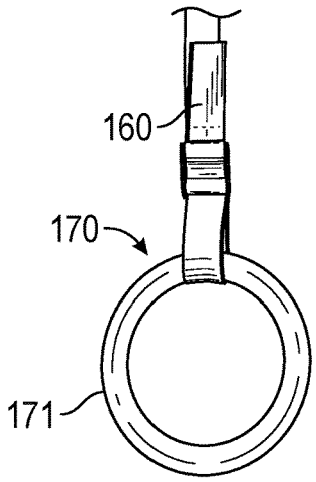
FIG. 5 is a partial view of the invention, showing an embodiment of a user engagement mechanism in the form of a ring handle.
Figure 6:
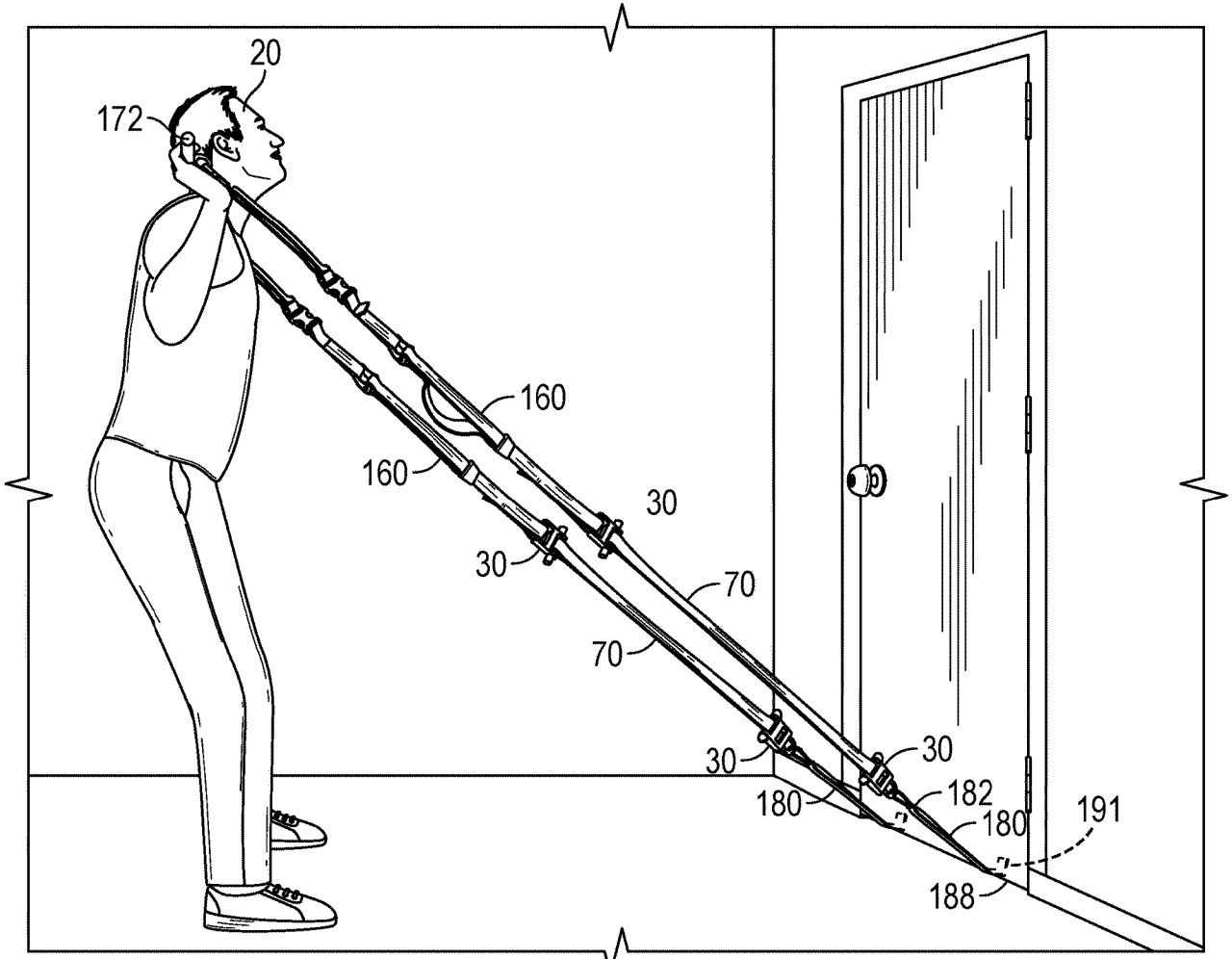
FIG. 6 is a perspective view of the invention in-use with a door bracket.
Figure 7:
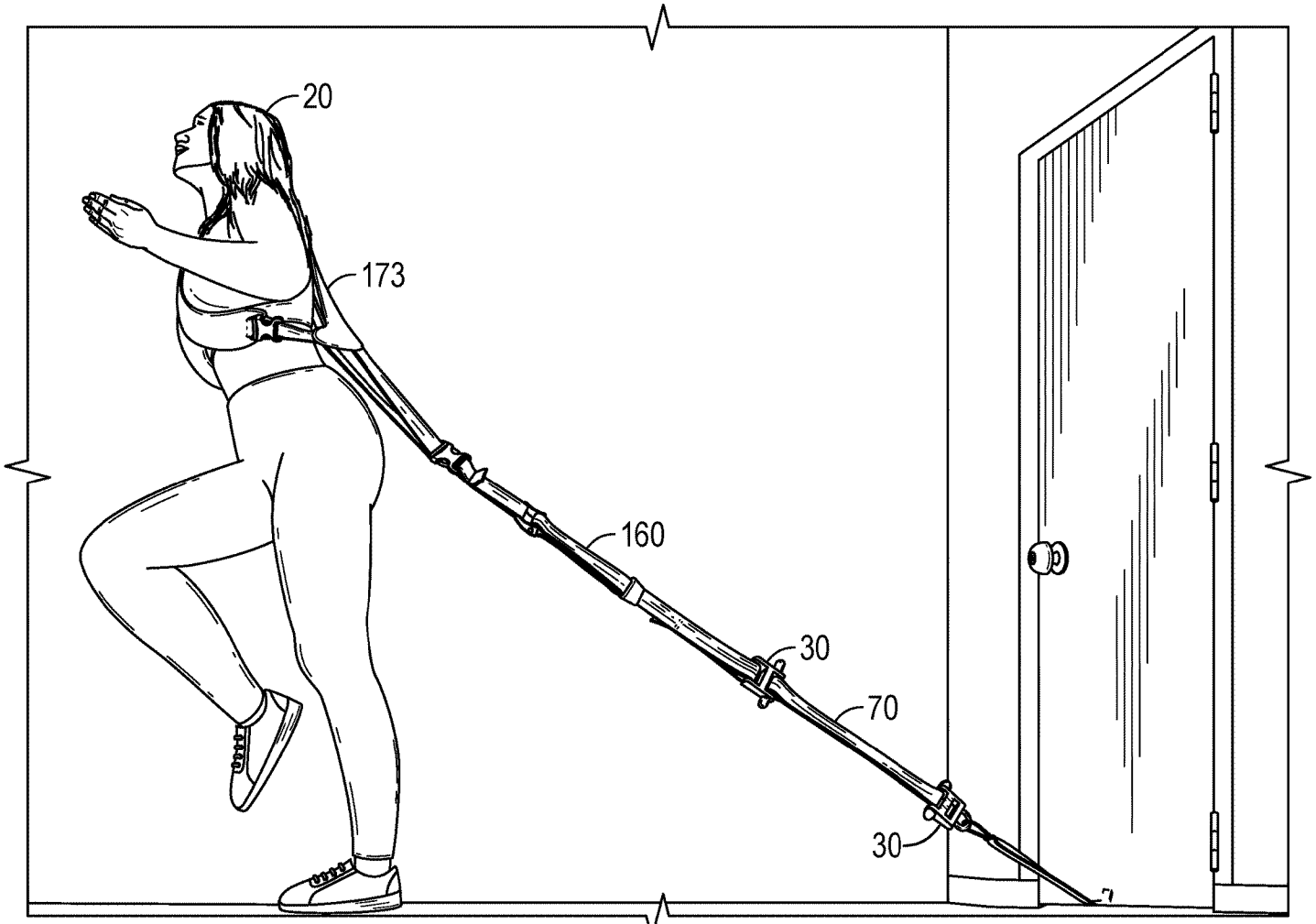
FIG. 7 is a perspective view of the invention, showing an embodiment of the user engagement mechanism in the form of a training vest.
Figure 8:
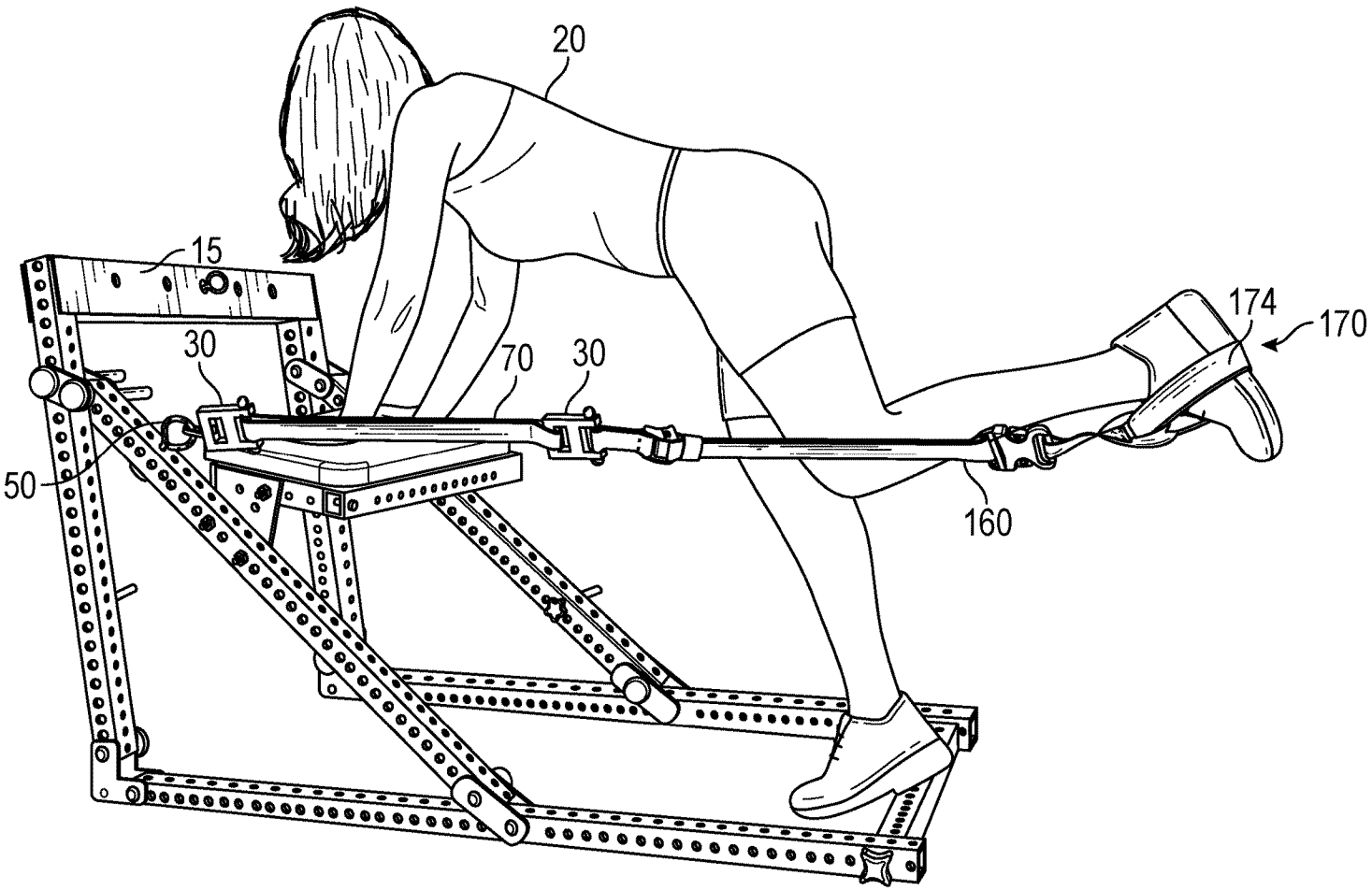
FIG. 8 is a perspective view of the invention, showing an embodiment of the user engagement mechanism in the form of a foot strap.

Preferably the resistance band apparatus 10 further includes a proximal strap 160 fixed at a distal end 168 thereof with the first attachment mechanism 50 of a first resistance band buckle 30. The proximal strap 160 is fixed at a proximal end 162 thereof with a user interface mechanism 170, such as a ring handle 171 (FIG. 5), an elongated bar 172 (FIGS. 6 and 9), a training vest 173 (FIG. 7), a foot strap 174 (FIG. 8), a skit handle 175 (FIG. 4), or the like. The proximal strap 160 may further include a length adjustment mechanism 200, such that the length of the proximal strap 160 may be selectively set at a desired length between a minimum proximal strap length and a maximum proximal strap length determined by the over length of the proximal strap 160 used and the configurations of the length adjustment mechanism 200, which is preferably a conventional strap length adjustment buckle. The proximal strap 160 is preferably a conventional nylon strap or the like.

A distal strap 180 may be fixed at a proximate end 188 thereof with the first attachment mechanism 50 of a second opposing resistance band buckle 30. The distal strap 180 is fixed at a distal end 182 thereof with an object engagement mechanism 190, such as an L-shaped door bracket 191 (FIGS. 4 and 6), a carabiner (not shown), another strap (not shown) or the like. With the object engagement mechanism 190 fixed with the fixed object 15, the person 20 may use the user interface mechanism 170 to pull the resistance bands 70 apart to perform the resistance exercises. The distal strap 180 may further include another of the length adjustment mechanism 200, such that the length of the distal strap 180 may be selectively set at a desired length between a minimum distal strap length and a maximum distal strap length determined by the over length of the distal strap 180 used and the configurations of the length adjustment mechanism 200, which is preferably a conventional strap length adjustment buckle. The distal strap 180 is preferably a conventional nylon strap or the like.

While a particular form of the invention has been illustrated and described, it will be apparent that various modifications can be made without departing from the spirit and scope of the invention. For example, additional snap-type plastic fasteners may be interposed between components of the invention described herein for facilitating quick interchanging of types of user interface mechanisms 170, types of object engagement mechanisms 190, or the like. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A resistance band apparatus for a person to perform resistance exercises, comprising:

a pair of resistance band buckles, each buckle including a first end and a second end, the first end having a first attachment mechanism and the second end having at least one second attachment mechanism, the first attachment mechanism of each buckle including a rigid eyelet, such that the resistance band can be stretched between two objects that are engaged with the rigid eyelets of the two buckles;

at least one elastomeric resistance band having two ends, each end adapted for attachment to the second end of one of the resistance band buckles;

wherein the first end of each buckle includes an elongated fastener aperture and wherein the rigid eyelet includes a threaded shaft projecting through the first end of the buckle and into the elongated fastener aperture to receive a threaded nut;

whereby the person pulls each resistance band buckle apart to perform the resistance exercises.

2. A resistance band apparatus for a person to perform resistance exercises, comprising:

a pair of resistance band buckles, each buckle including a first end and a second end, the first end having a first attachment mechanism and the second end having at least one second attachment mechanism;

at least one elastomeric resistance band having two ends, each end adapted for attachment to the second end of one of the resistance band buckles;

wherein the second end of each buckle includes a clevis having a pair of opposing lateral bolt fingers, a fastening bolt adapted to traverse a pair of opposing and aligned bolt apertures formed through the bolt fingers and to receive therearound a loop formed at each of the ends of at least one of the elastomeric resistance bands, whereby the fastening bolt of each buckle can be inserted through one of the fingers, through the loop of one end of the elastomeric band, and through the opposing finger to secure the elastomeric band to the buckle, the elastomeric band being relatively flat and aligned with each of the buckles;

whereby the person pulls each resistance band buckle apart to perform the resistance exercises.

3. A resistance band apparatus for a person to perform resistance exercises, comprising:

a pair of resistance band buckles, each buckle including a first end and a second end, the first end having a first attachment mechanism and the second end having at least one second attachment mechanism;

at least one elastomeric resistance band having two ends, each end adapted for attachment to the second end of one of the resistance band buckles;

wherein each buckle further includes a plurality of resistance band slots accessible from the second end of the buckle, each slot including at least a portion of the second attachment mechanism;

and wherein each slot includes a widened keyway, and wherein at least one resistance band further includes a corresponding widened head adapted to slide into the keyway, such that the slot retains the resistance band therein when the resistance band is stretched;

and wherein at least one resistance band having the head further includes a tab projecting away from the head, the tab including a pin aperture therethrough, each buckle including a transverse pin aperture traversing each slot at the tab when the resistance band is engaged with the slot, a pin adapted for fixing the resistance band to the slot;

whereby the person pulls each resistance band buckle apart to perform the resistance exercises.

4. The resistance band apparatus of claim 1 further including:

a proximal strap fixed at a distal end thereof with the first attachment mechanism of a first of the resistance band buckles, the proximal strap fixed at a proximal end thereof with a user interface mechanism; and a distal strap fixed at a proximal end thereof with the first attachment mechanism of a second of the resistance band buckles, the distal strap fixed at a distal end thereof with an object engagement mechanism;

whereby with the object engagement mechanism fixed with a fixed object, a person may use the user interface mechanism to pull the modular exercise band to stretch the at least one resistance band to perform the resistance exercises.

5. The resistance band apparatus of claim 4 wherein the distal strap further includes a length adjustment mechanism, whereby the length of the distal strap may be selectively set at a desired length between a minimum distal strap length and a maximum distal strap length.

6. The resistance band apparatus of claim 4 wherein the proximal strap further includes a length adjustment mechanism, whereby the length of the proximal strap may be selectively set at a desired length between a minimum proximal strap length and a maximum proximal strap length.

7. The resistance band apparatus of claim 4 wherein the user interface mechanism takes the form of a ring handle.

8. The resistance band apparatus of claim 4 wherein the user interface mechanism takes the form of an elongated bar.

9. The resistance band apparatus of claim 4 wherein the user interface mechanism takes the form of a training vest.

10. The resistance band apparatus of claim 4 wherein the user interface mechanism takes the form of a foot strap.

11. The resistance band apparatus of claim 4 wherein the user interface mechanism takes the form of a ski handle.

12. The resistance band apparatus of claim 4 wherein the object engagement mechanism takes the form of an L-shaped door bracket.

13. The resistance band apparatus of claim 4 wherein the object engagement mechanism takes the form of a carabiner.

14. The resistance band apparatus of claim 1 wherein the at least one elastomeric resistance band is a plurality of elastomeric resistance bands, each having unique lengths.

15. The resistance band apparatus of claim 1 wherein the at least one elastomeric resistance band is a plurality of elastomeric resistance bands, each having unique elasticity.

16. The resistance band apparatus of claim 2 further including:

a proximal strap fixed at a distal end thereof with the first attachment mechanism of a first of the resistance band buckles, the proximal strap fixed at a proximal end thereof with a user interface mechanism; and a distal strap fixed at a proximal end thereof with the first attachment mechanism of a second of the resistance band buckles, the distal strap fixed at a distal end thereof with an object engagement mechanism;

whereby with the object engagement mechanism fixed with a fixed object, a person may use the user interface mechanism to pull the modular exercise band to stretch the at least one resistance band to perform the resistance exercises.

17. The resistance band apparatus of claim 16 wherein the object engagement mechanism takes the form of a carabiner.

18. The resistance band apparatus of claim 3 further including:

a proximal strap fixed at a distal end thereof with the first attachment mechanism of a first of the resistance band buckles, the proximal strap fixed at a proximal end thereof with a user interface mechanism; and a distal strap fixed at a proximal end thereof with the first attachment mechanism of a second of the resistance band buckles, the distal strap fixed at a distal end thereof with an object engagement mechanism;

whereby with the object engagement mechanism fixed with a fixed object, a person may use the user interface mechanism to pull the modular exercise band to stretch the at least one resistance band to perform the resistance exercises.

* * * * *